US011016430B2

(12) United States Patent
Yamagishi

(10) Patent No.: US 11,016,430 B2
(45) Date of Patent: May 25, 2021

(54) TRANSFER UNIT AND IMAGE FORMING APPARATUS INCLUDING A GUIDE MEMBER HAVING A TIP END PORTION

(71) Applicant: FUJI XEROX CO., LTD., Tokyo (JP)

(72) Inventor: Kazunari Yamagishi, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 16/544,162

(22) Filed: Aug. 19, 2019

(65) Prior Publication Data

US 2020/0310300 A1 Oct. 1, 2020

(30) Foreign Application Priority Data

Mar. 25, 2019 (JP) ..... JP2019-057344

(51) Int. Cl.
*G03G 15/00* (2006.01)

(52) U.S. Cl.
CPC ..... *G03G 15/6558* (2013.01)

(58) Field of Classification Search
CPC ..... G03G 15/16; G03G 15/6558
See application file for complete search history.

(56) References Cited

U.S. PATENT DOCUMENTS 9,798,272 B2 * 10/2017 Nakajima ..... G03G 15/6558

FOREIGN PATENT DOCUMENTS

| | | |
|---|---|---|
| JP | 2000-214695 A | 8/2000 |
| JP | 2007-003650 A | 1/2007 |
| JP | 2014-186255 A | 10/2014 |

* cited by examiner

*Primary Examiner* — Arlene Heredia
(74) *Attorney, Agent, or Firm* — Sughrue Mion, PLLC

(57) ABSTRACT

A transfer unit includes: a transfer body that forms a transfer nip together with an image holding member provided to hold a developer image and allows a recording medium to be nipped in and transported through the transfer nip so that a developer image is transferred to the recording medium; and a guide member that intersects a tangent to the transfer nip and has a tip end portion located closer to the image holding member across the tangent when viewed in an axial direction, and guides the recording medium transported from an upstream side to the transfer nip, wherein the tip end portion has plural regions having different distances from the image holding member.

5 Claims, 11 Drawing Sheets

TRANSFER UNIT AND IMAGE FORMING APPARATUS INCLUDING A GUIDE MEMBER HAVING A TIP END PORTION

CROSS-REFERENCE TO RELATED APPLICATIONS

This application is based on and claims priority under 35 USC 119 from Japanese Patent Application No. 2019-057344 filed Mar. 25, 2019.

BACKGROUND

(i) Technical Field

The present disclosure relates to a transfer unit and an image forming apparatus.

(ii) Related Art

JP-A-2000-214695 discloses a technique related to an image forming apparatus such as a printer, a facsimile, and a copying machine. In the related art, a paper transport roller is located on a transfer unit side with respect to a nip tangent passing through a nip point, and a cutout portion formed in part of a paper guide adjacent to an image carrying body and the transfer unit is located on a transfer unit side with respect to the nip tangent.

JP-A-2007-003650 discloses a technique related to an image forming apparatus such as a copying machine, a printer, a facsimile machine, and a composite machine of these, which is an electrostatic copying system. In the related art, when fed to a nip portion between a photosensitive drum and a transfer roller, a sheet material is nipped between the photosensitive drum and the nip portion of the transfer roller and pressed against the vicinity (transporting guide rib) of an end portion of a sheet material guide surface on the downstream side in the direction of transport of the sheet material while being nipped in the nip portion between a pair of the registration rollers, so that the sheet material is deformed by the sheet material guide surface (transporting guide rib) of the pre-transfer guide so as to follow the deflection deformation of the transfer roller. As a result, in the operation of transfer onto the sheet material nipped in the nip portion between the photosensitive drum and the transfer roller, the force from axial both ends of the transfer roller toward the axially central portion is less likely to act on the sheet material, so that wrinkling is prevented.

In many cases, a guide member for guiding the recording medium is provided upstream of the transfer nip between the image holding member and the transfer body with respect to the transport direction. It is also known that the tip end portion of the guide member on the downstream side in the transport direction extends toward the image holding member side across the tangent to the transfer nip.

However, if the tip end portion of the guide member is located closer to the image holding member across the tangent, a thick and narrow (and therefore high bending rigidity) recording medium, such as a postcard, may cause an increase in transport load, so that transfer failure, such as displacement of the developer image transferred to the recording medium, may occur.

SUMMARY

Aspects of non-limiting embodiments of the present disclosure relate to reducing the risk of transfer failure compared with a case where the tip end portion of the guide member is linear in a configuration in which the tip end portion of the guide member on the downstream side in the transport direction is closer to the image holding member across the tangent to the transfer nip.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the disclosure, there is provided a transfer unit including: a transfer body that forms a transfer nip together with an image holding member provided to hold a developer image and allows a recording medium to be nipped in and transported through the transfer nip so that a developer image is transferred to the recording medium; and a guide member that intersects a tangent to the transfer nip and has a tip end portion located closer to the image holding member across the tangent when viewed in an axial direction, and guides the recording medium transported from an upstream side to the transfer nip, wherein the tip end portion has plural regions having different distances from the image holding member.

BRIEF DESCRIPTION OF THE DRAWINGS

Exemplary embodiments of the present invention will be described in detail based on the following figures, wherein.

DETAILED DESCRIPTION

Exemplary Embodiment

An example of an image forming apparatus according to an exemplary embodiment of the present disclosure will be described. Two directions orthogonal to the horizontal direction are taken as an X direction and a Y direction, and are indicated by arrows X and Y, respectively. Further, a vertical direction orthogonal to the X direction and the Y direction is taken as a Z direction, and is indicated by an arrow Z. Also, the X direction is the device width direction, the Y direction is the device depth direction, and the Z direction is the device vertical direction.

Overall Configuration

First, an overall configuration of an image forming apparatus 10 will be described.

Figure 1:
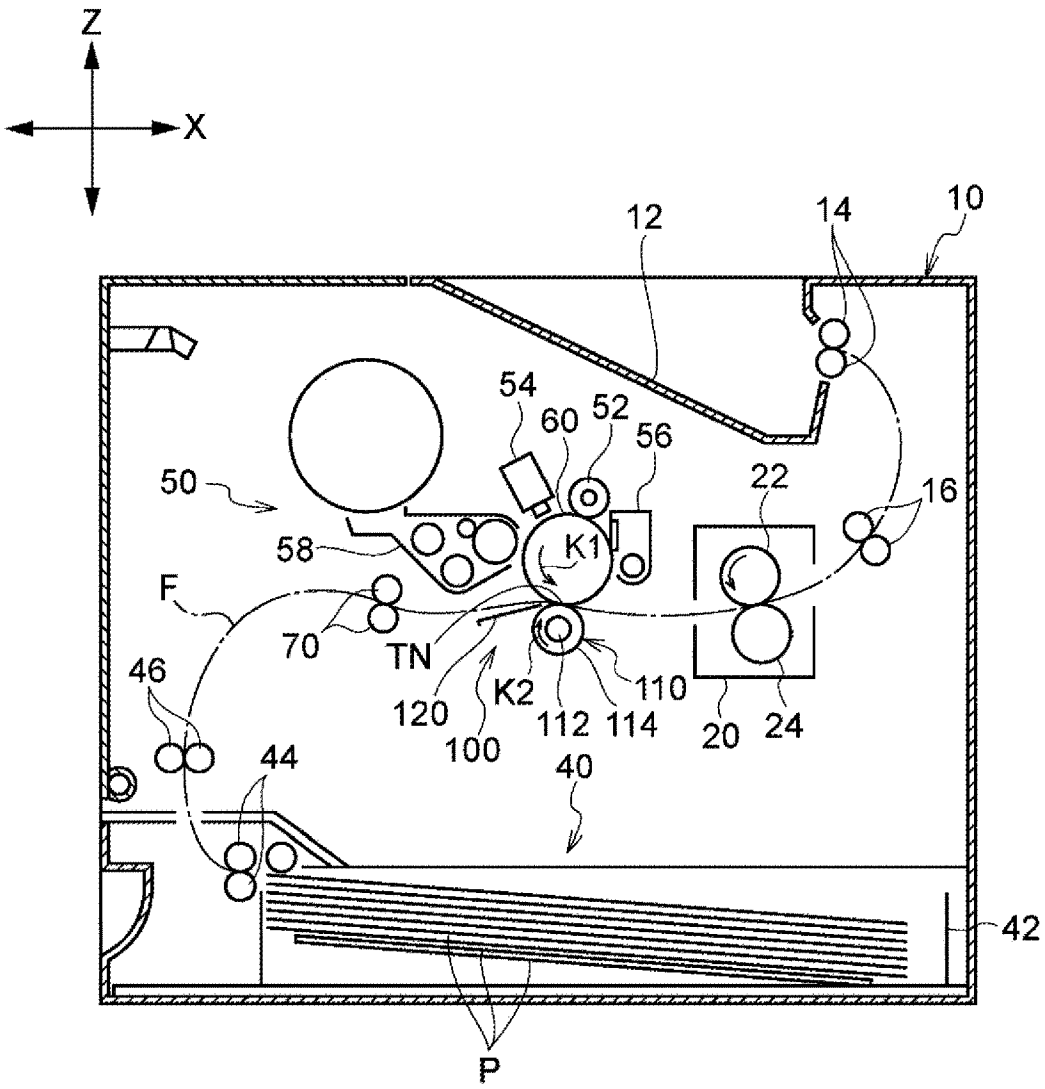
FIG. 1 is a schematic configuration diagram of an image forming apparatus.

As shown in FIG. 1, the image forming apparatus 10 has an image forming portion 50, a transfer unit 100, and a fixing device 20.

Figure 2:
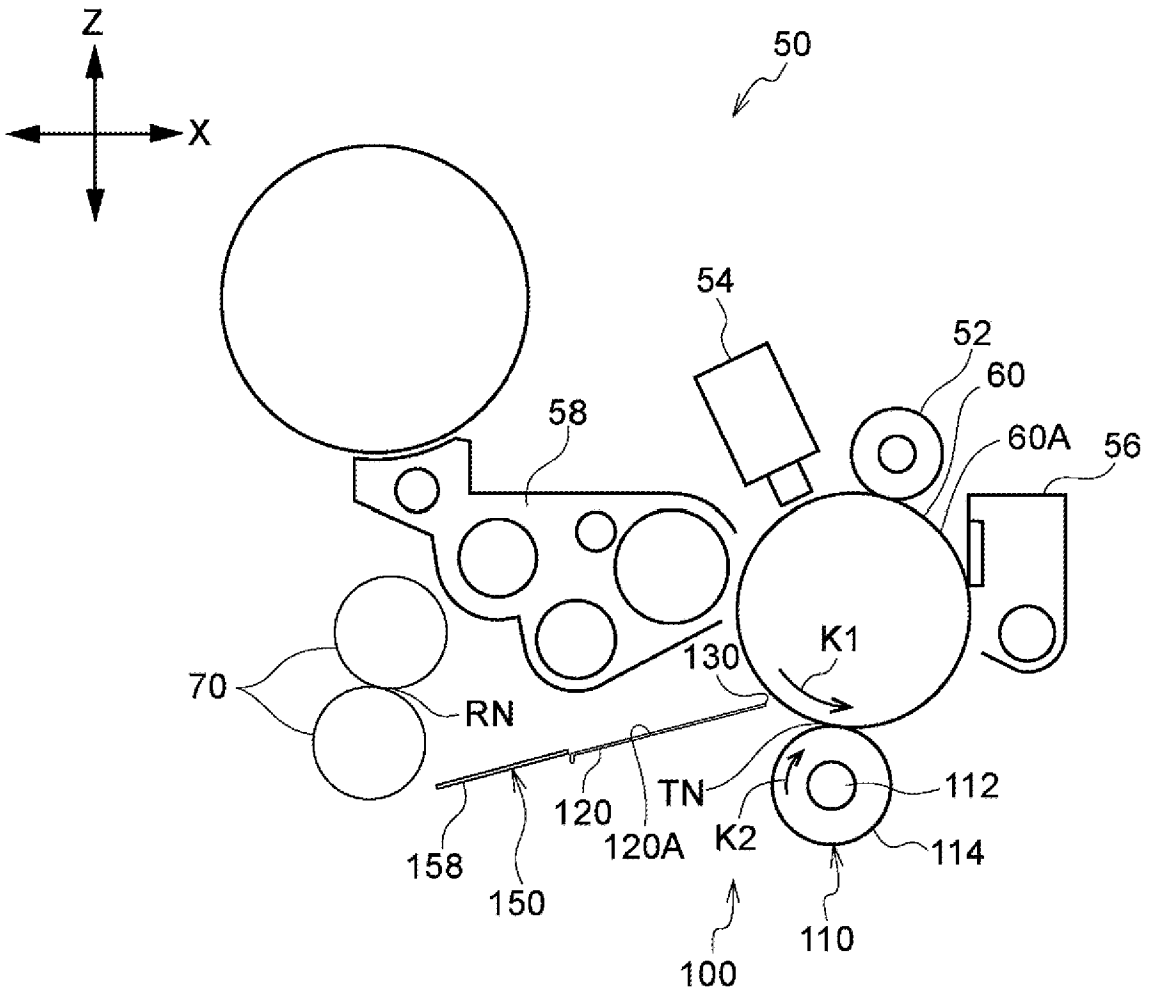
FIG. 2 is a schematic configuration diagram of an image forming portion.

As shown in FIGS. 1 and 2, the image forming portion 50 includes a photosensitive body 60, a charger 52, an exposure device 54, a developing device 58, and a cleaning device 56. The charger 52 as an example of a charging unit makes an outer peripheral surface 60A of the cylindrical photosensitive body 60 to be charged as an example of the image holding member. The exposure device 54 as an example of an electrostatic latent image forming unit irradiates the photosensitive body 60 whose outer peripheral surface 60A is charged with light based on the image data to form an electrostatic latent image on the photosensitive body 60. The developing device 58 as an example of a developing unit develops the electrostatic latent image formed on the photosensitive body 60 with toner as an example of a developer, and visualizes it as a toner image. Further, the cleaning device 56 cleans and recovers the toner and the like remaining on the photosensitive body 60 after the toner image is transferred.

The transfer unit 100 has a guide member 120 and a transfer roll 110. The transfer roll 110 as an example of a transfer body is supplied with a transfer voltage from a power supply (not shown), and transfers a toner image as an example of a developer image formed on the outer peripheral surface 60A of the photosensitive body 60 to a sheet material P (see FIG. 1) supplied along a transporting path F (see FIG. 1) at a transfer nip TN.

The arrow K1 in the drawings indicates a rotation direction of the drum-like photosensitive body 60, and the arrow K2 indicates the rotation direction of the transfer roll 110.

The guide member 120 guides the sheet material P transported from the upstream side in the transport direction to the transfer nip TN.

A detailed description of the transfer unit 100 will be described later.

A pair of registration rolls 70 is provided on the upstream side of the transfer roll 110 in the transport direction. The registration rolls 70 feed the sheet material P to the transfer nip TN by starting rotation according to the transfer timing.

The fixing device 20 shown in FIG. 1 is provided with a heating roll 22 and a pressure roll 24. By passing the sheet material P between the heating roll 22 and the pressure roll 24, the toner image transferred to the sheet material P is fixed to the sheet material P by heat and pressure.

On the downstream side of the fixing device 20 in the transport direction, output rolls 14 and 16 and the like for outputting the sheet material P to which the toner age is fixed to an output portion 12 are provided.

A paper feeding device 40 for feeding the sheet material P one by one is provided at the lower portion of the image forming apparatus 10. The paper feeding device 40 is provided with a storage portion 42 in which plural sheet materials P such as a recording paper as an example of a recording medium are stacked. The sheet material P stacked in the storage portion 42 is sequentially taken out by a take-out roll 44 and the like, and transported one by one. Plural transport rollers 48 are provided along the transporting path F of the sheet material P. The sheet material P is transported to the downstream side in the transport direction of the sheet material P along the transporting path F.

Figure 4:
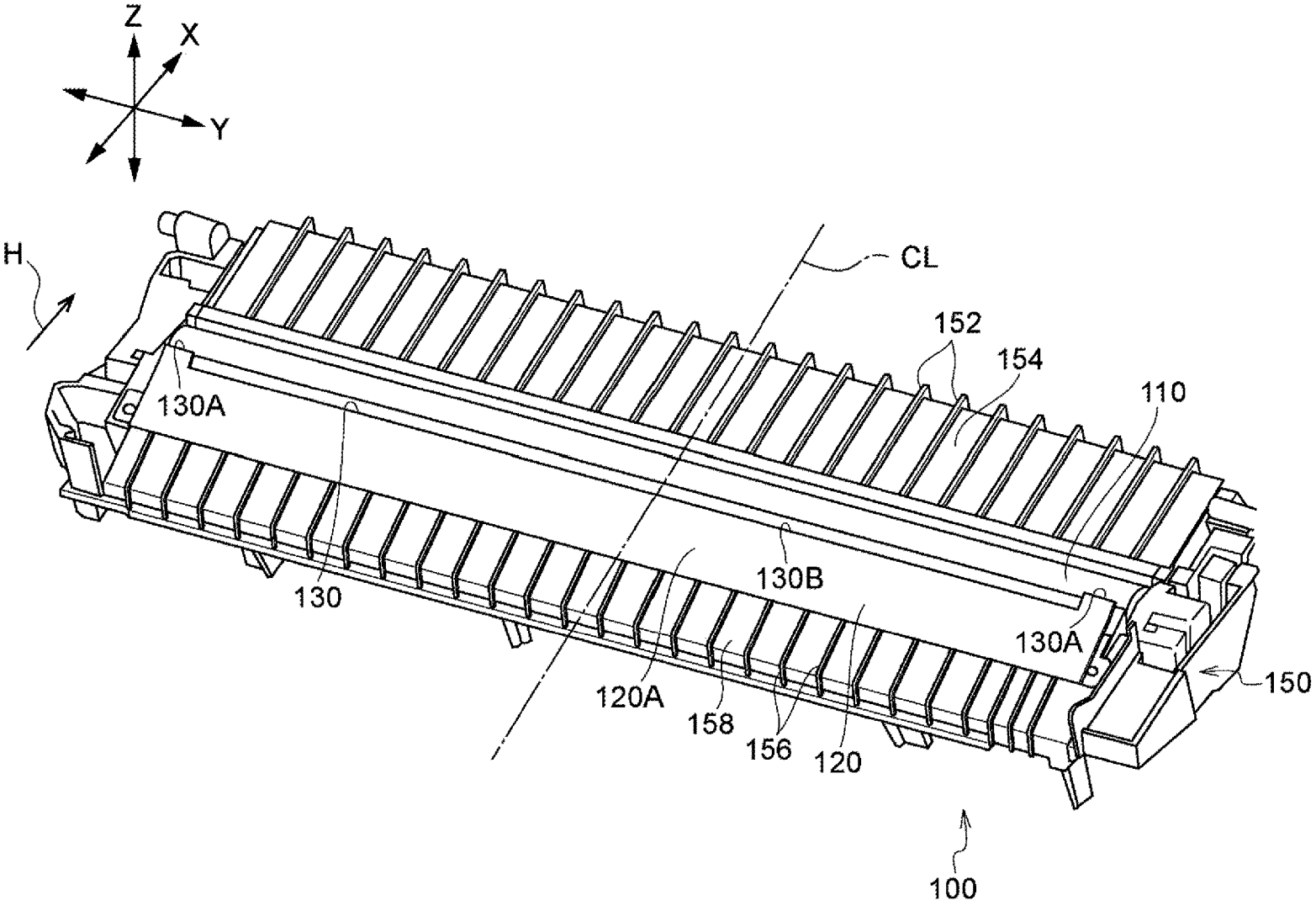
FIG. 4 is a perspective view of the transfer unit.
Figure 5:
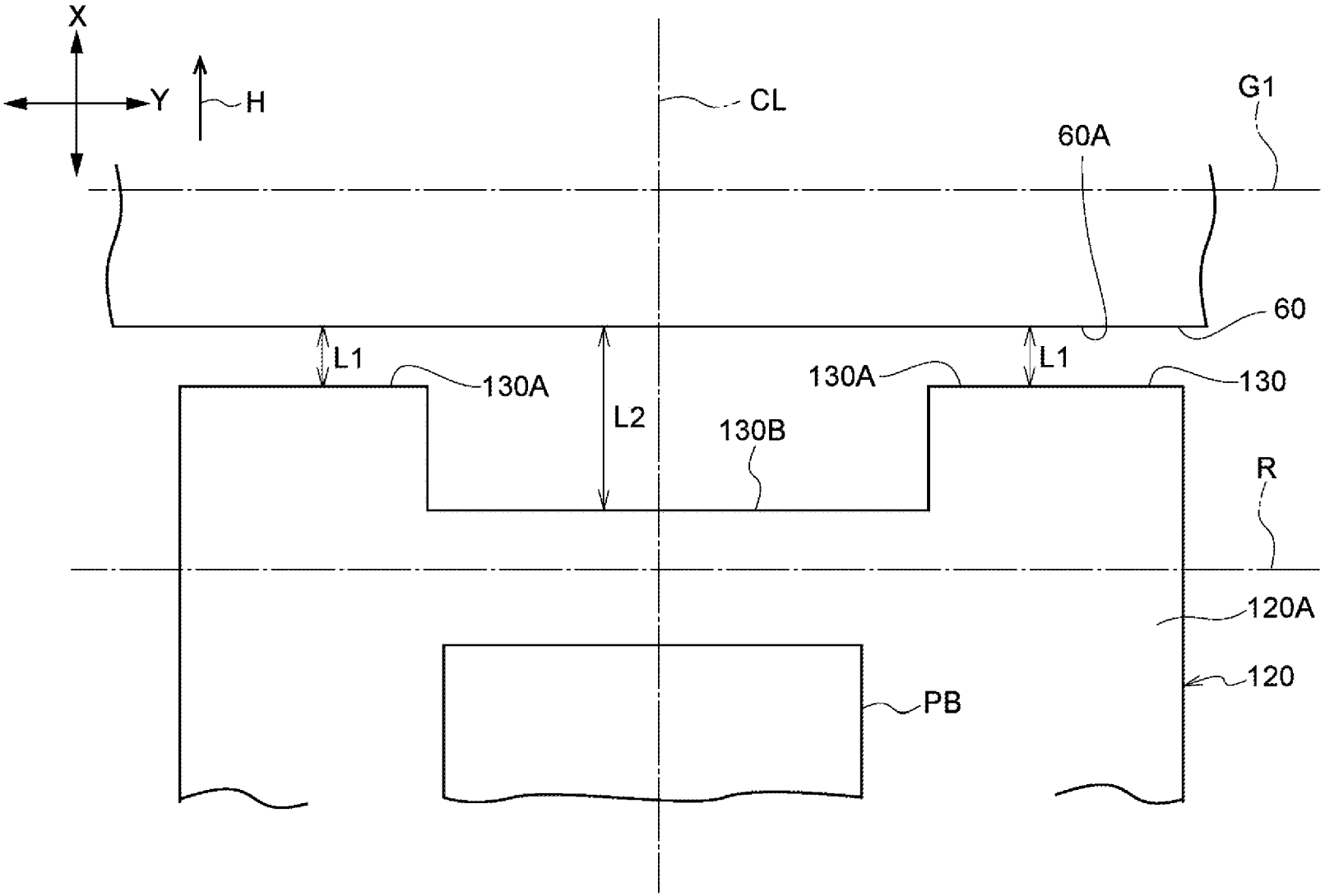
FIG. 5 is a plan view of a tip end portion of a guide member.

FIGS. 4 and 5 show a center line CL which is an axial center of the transporting path. In the present exemplary embodiment, the center line CL is used as a transport reference of the sheet material P, and the sheet material P is transported such that the center in the sheet width direction passes through the center line CL.

The image forming apparatus 10 of the present exemplary embodiment can form an image on at least two kinds of sheet materials P such as a plain paper PA (not shown) and a first small-width sheet PB (see FIG. 5). The plain paper PA (not shown) is a so-called A4 size plain paper. The first small-width sheet PB (see FIG. 5) is a sheet material, for example, a postcard, which is thicker and has a smaller sheet width and a higher bending rigidity than the plain paper PA. Both the plain paper PA and the first small-width sheet PB (see FIG. 5) are transported such that the center of the sheet width direction passes through the center line CL.

Image Forming Process

Next, an image forming process of the image forming apparatus 10 will be described.

First, the charger 52 makes the outer peripheral surface 60A of the photosensitive body 60 to be charged. Next, the exposure device 54 exposes the charged outer peripheral surface 60A of the photosensitive body 60 to light based on image data read by a scanner (not shown) or data sent from the outside to from an electrostatic latent image on the outer peripheral surface 60A of the photosensitive body 60. Then, the developing device 58 develops the electrostatic latent image and visualizes it as a toner image.

On the other hand, the sheet material P is sent out from the storage portion 42 to the transporting path F. The sheet material P sent out to the transporting path F passes through the transfer nip TN formed between the photosensitive body 60 holding the toner image and the transfer roll 110, and the toner image is transferred onto the sheet material P by the transfer voltage applied to the transfer roll 110. The toner image transferred to the sheet material P is fixed to the sheet material P by passing between the heating roll 22 and the pressure roll 24 of the fixing device 20. The sheet material P to which the toner image is fixed is output to the output portion 12 by the output rolls 14 and 16.

Details of Transfer Unit

Next, details of the transfer unit 100 will be described.

Figure 3:
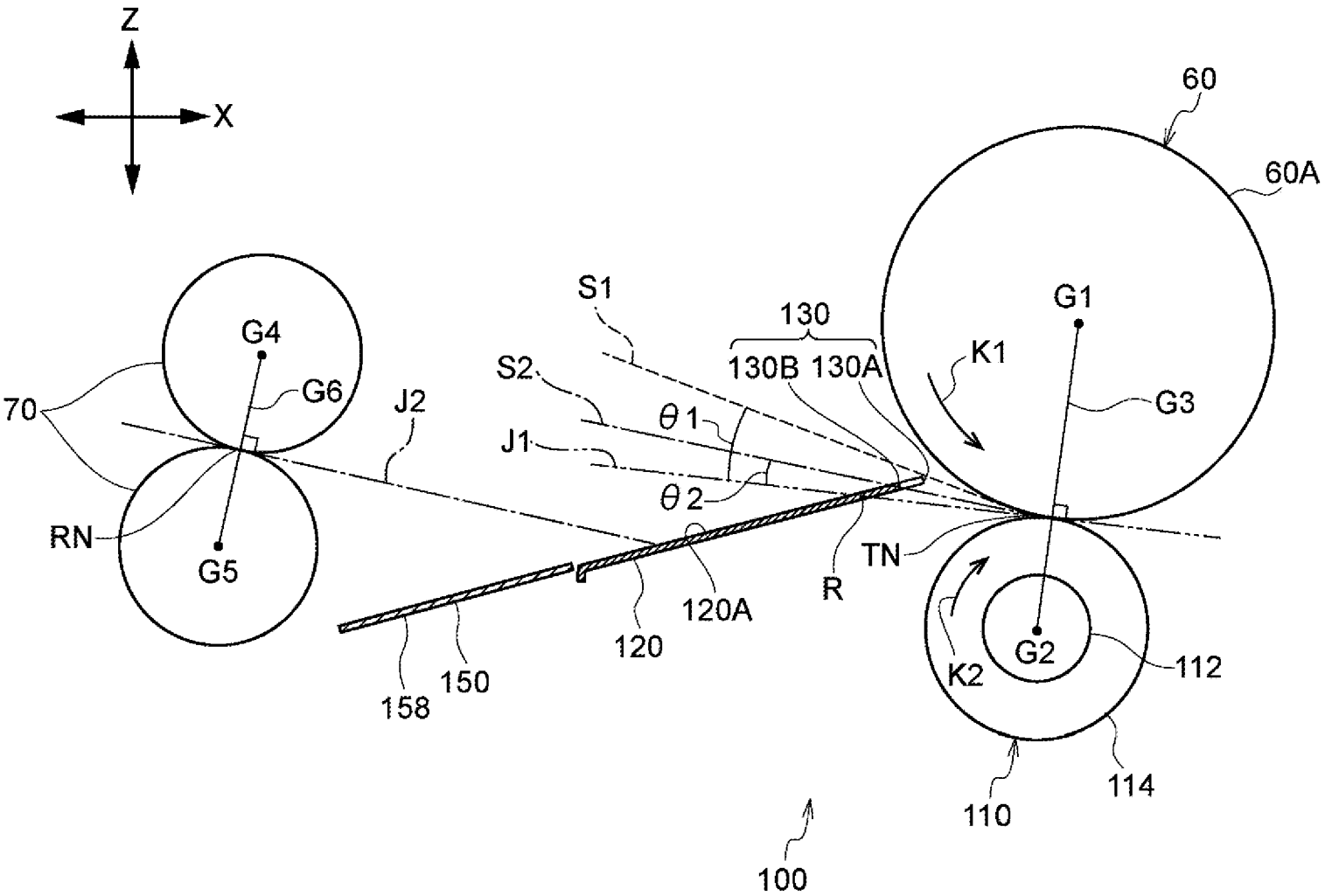
FIG. 3 is a side view showing a transfer unit in a partial cross section viewed in an axial direction.

As shown in FIGS. 2 and 3, the transfer unit 100 has the transfer roll 110 as an example of a transfer body and the guide member 120. The guide member 120 of the present exemplary embodiment is formed of a metal plate and is electrically grounded. The transfer roll 110 has a metallic shaft portion 112 and a semiconductive elastic layer 114 provided around the shaft portion 112.

As shown in FIG. 4, the transfer unit 100 holds the transfer roll 110, and has a housing portion 150 to which the guide member 120 is fixed. The housing portion 150 is made of resin and holds the transfer roll 110 at an intermediate portion in the transport direction of the sheet material P indicated by the arrow H. A downstream side transporting guide 154 in which plural ribs 152 are formed is provided at the transport direction downstream of the transfer roll 110 in the housing portion 150. An upstream side transporting guide 158 in which plural ribs 156 are formed is provided at the transport direction upstream of the transfer roll 110 in the housing portion 150.

The above-described guide member 120 is provided on the transfer roll 110 side with respect to the upper surface of the upstream side transporting guide 158. Since the guide member 120 is formed of a plate as described above, and the upper guide surface 120A is a flat surface.

As shown in FIGS. 2 and 3, the above-described registration rolls 70 are provided on the upstream side of the transport direction of the upstream side transporting guide 158 (see FIG. 4) of the housing portion 150 in the transfer unit 100.

The transfer roll 110 forms the transfer nip TN with the drum-shaped photosensitive body 60, transports the sheet material P nipped in the transfer nip TN, and transfers the toner image to the sheet material P. The guide member 120 guides the sheet material P transported from the upstream side in the transport direction to the transfer nip TN.

Figure 6:
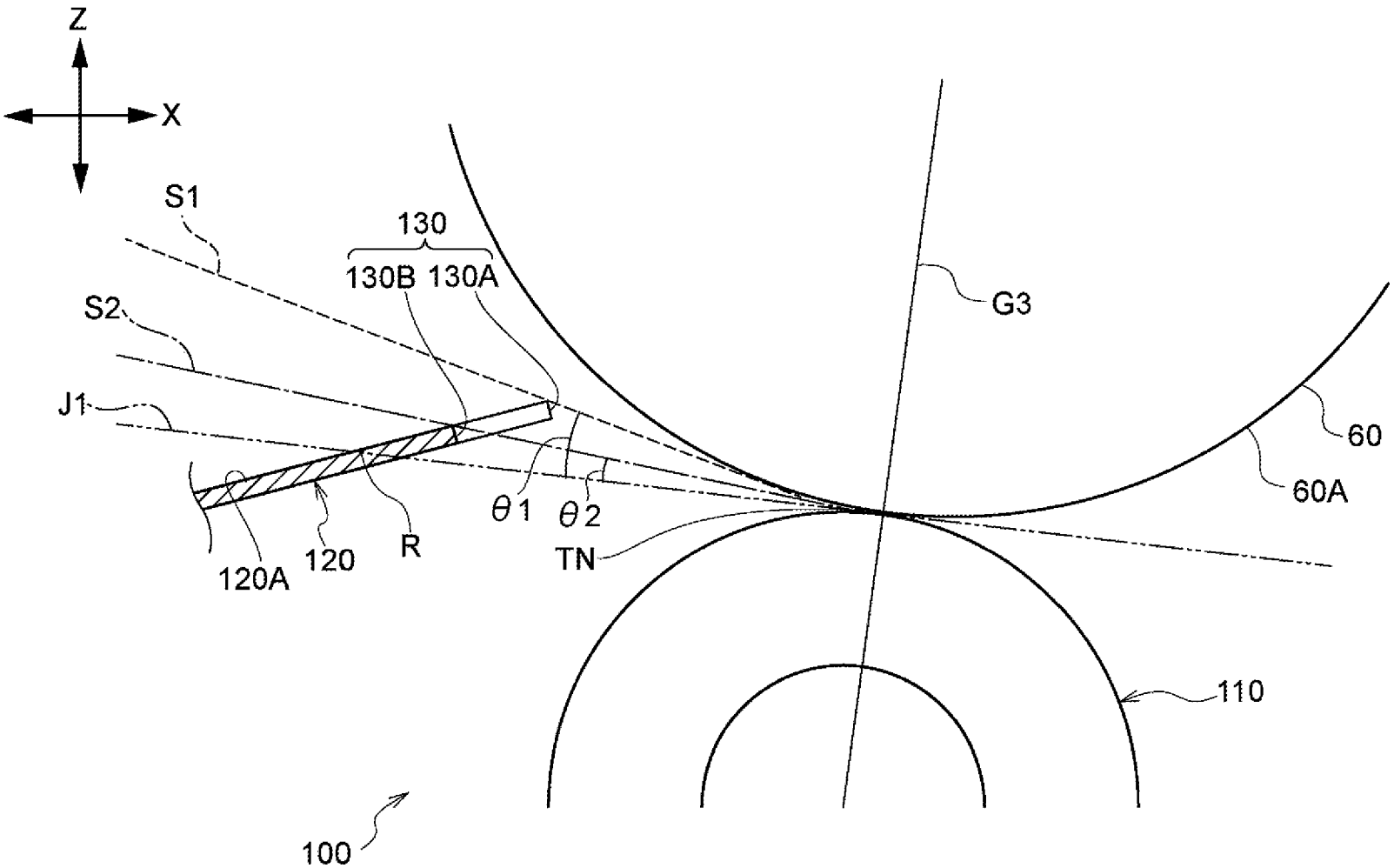
FIG. 6 is a side view of the tip end portion of the guide member viewed in the axial direction.

As shown in FIGS. 3 and 6, in the present exemplary embodiment, the upper guide surface 120A of the guide member 120 has an upward slope toward the transfer nip TN side. The guide surface 120A of the guide member 120 intersects a tangent J1 of the transfer nip TN when viewed in the axial direction, and a tip end portion 130 on the downstream side in the transport direction is located closer to the photosensitive body 60 side than to the tangent J1. An intersection position R shown in FIGS. 3 and 6 is a position at which the guide surface 120A of the guide member 120 intersects with the tangent J1.

Here, the above-described "axial direction" is an axial direction of a rotation axis G1 of the photosensitive body 60 or a rotation axis G2 of the transfer roll 110. The tangent J1 is a tangent to the photosensitive body 60 and the transfer roll 110 in the transfer nip TN. Describing from another point of view, the tangent J1 is a line orthogonal to a line G3 passing through the rotation axis G1 (see FIG. 3) of the photosensitive body 60 and the rotation axis G2 (see FIG. 3) of the transfer roll 110 in the transfer nip TN.

As shown in FIGS. 4 and 5, the tip end portion 130 of the guide member 120 has plural regions having different distances from the outer peripheral surface 60A of the photosensitive body 60 (FIG. 5). In the present exemplary embodiment, the tip end portion 130 has a first region 130A with a distance L1 (FIG. 5) from axial both sides and a second region 130B with a distance L2 (FIG. 5) at an axially central portion. The distance L2 from the second region 130B is longer than the distance L1 from the first region 130A. That is, the relationship of distance L1<distance L2 is established. In other words, the tip end portion 130 of the guide member 120 has a concave shape in a plan view. The first region 130A and the second region 130B are both located closer to the photosensitive body 60 (FIG. 5) side than to the intersection position R. In the present exemplary embodiment, the distance L1 is 3 mm or less and 1.4 mm or more, and preferably 2.5 mm or less and 2 mm or more. The distance L2 is 3.6 mm or less and 2.6 mm or more, and preferably 3.5 mm or less and 3 mm or more.

From another point of view, as shown in FIGS. 3 and 6, the tip end portion 130 of the guide member 120 has plural regions with different angles between the tangent J1 and virtual lines S connecting the tip end portion 130 and the transfer nip TN when viewed in the axial direction. In the present exemplary embodiment, the tip end portion 130 has a first region 130A (see FIG. 5) with a virtual line S1 making an angle θ1 with the tangent J1 and a second region 130B (see FIG. 5) with a virtual line S2 making an angle θ2 with the tangent J1. The angle θ1 is larger than the angle θ2. That is, the relationship of angle θ1>angle θ2 is established. In the present exemplary embodiment, the angle θ1 is 8.8° or less and 4° or more, and preferably 8° or less and 5° or more. The angle θ2 is 6° or less and 1° or more, and preferably 5° or less and 2° or more.

The axial width of the above-mentioned plain paper PA (not shown) is larger than the width of the second region 130B, and the axial width of the first small-width sheet PB (see FIG. 5) is smaller than the width of the second region 130B. Therefore, the plain paper PA (not shown) is guided to the transfer nip TN by both first regions 130A of the tip end portion 130 of the guide member 120, and the first small-width sheet PB (see FIG. 5) is guided to the transfer nip TN by the second region 130B of the tip end portion 130 of the guide member 120.

As shown in FIG. 3, when viewed in the axial direction, a tangent J2 of registration roll nips RN of the pair of registration rolls 70 is in a positional relationship intersecting the guide surface 120A of the guide member 120. Describing from another point of view, the tangent J2 is a line orthogonal to the tangent J2 passing through a rotation axis G4 and a rotation axis G5 of the registration rolls 70 in the registration roll nip RN. In the present exemplary embodiment, the tangent J2 has a downward slope from the downstream side in the transport direction toward the upstream side in the transport direction.

Operation

Next, the operation of the present exemplary embodiment will be described.

When viewed in the axial direction, the guide member 120 intersects with tangent J1 of the transfer nip TN, and the tip end portion 130 is located closer to the photosensitive body 60 side than to the tangent J1. Therefore, compared to the case of not intersecting the tangent J1, the discharge between the sheet material P guided to the transfer nip TN and the photosensitive body 60 is reduced by the guide member 120, and the transfer failure such as chain-like white spots in the toner image transferred to the sheet material P is prevented.

However, as the tip end portion 130 of the guide member 120 is located closer to the photosensitive body 60 across the tangent J1, the angle between the tangent and the above-mentioned virtual line becomes large. That is, as the tip end portion 130 of the guide member 120 is brought closer to the photosensitive body 60, the bending of the sheet material P becomes large.

Therefore, as the tip end portion 130 of the guide member 120 is brought closer to the photosensitive body 60, the first small-width sheet PB such as a postcard, which is thick and narrow and therefore has a large bending rigidity, may cause an increase in transport load so that transfer failure such as displacement of the toner image transferred to the sheet material P may occur, in contrast to the case of the plain paper PA.

Thus, in the present exemplary embodiment, the first small-width sheet PB is guided by the second region 130B with a longer distance to the photosensitive body 60 (FIG. 5) and a smaller angle between the tangent J1 and the virtual line S2 connecting the second region 130B and the transfer nip TN. Therefore, an increase in the transport load of the first small-width sheet PB is prevented, and the occurrence of transfer failure such as displacement of a toner image is prevented.

As described above, for both the plain paper PA and the first small-width sheet PB having different bending rigidities, both transfer failure due to discharge and transfer failure due to an increase in transport load are effectively prevented. Then, since transfer failure is prevented, image quality failure on the sheet material P after fixing due to transfer failure is prevented.

If the first region 130A of the tip end portion 130 of the guide member 120 is formed only on one side in the axial direction, since one side of the plain paper PA is guided by the first region 130A and the other side is guided by the second region 130B, the transport balance in the axial direction is lost, which may cause a transfer failure, which is not good.

Figure 7:
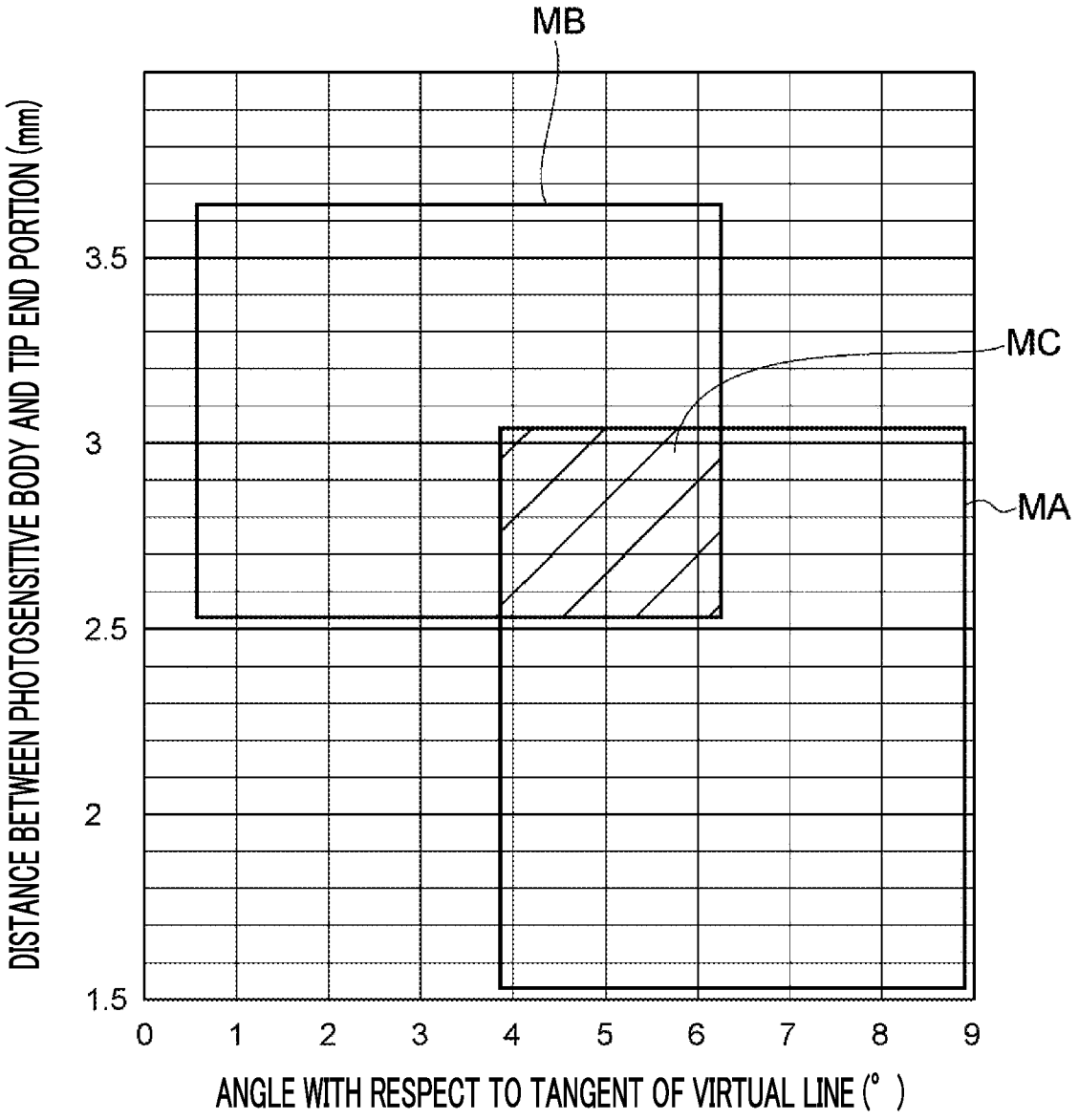
FIG. 7 is a graph showing a region where no transfer failure occurs in a plain paper and a first small-width sheet.

Here, FIG. 7 is a graph showing a region where no transfer failure occurs in the plain paper PA and the first small-width sheet PB. In the graph, the horizontal axis represents the angle between the tangent J1 and the virtual line connecting the tip end portion 130 of the guide member 120 and the transfer nip TN, and the vertical axis represents the distance between the photosensitive body 60 and the tip end portion 130 of the guide member 120.

A range MA in the graph is a range in which neither transfer failure due to discharge nor transfer failure due to an increase in transport load occurs on the plain paper PA. A range MB is a range in which neither transfer failure due to discharge nor transfer failure due to an increase in transport load occurs on the first small-width sheet PB. A range MC is a range in which neither of them occurs. That is, in the range MC, neither transfer failure due to discharge nor transfer failure due to an increase in transport load occurs on both the plain paper PA and the first small-width sheet PB.

However, the range MC is narrow, and it is relatively difficult to set the whole of the tip end portion 130 of the guide member 120 within this range MC in consideration of various tolerances and so on. Even if it can be set within the range MC, high accuracy may be required for manufacturing and positioning of the guide member 120, which may result in high costs.

Therefore, in the present exemplary embodiment, as described above, the first region 130A for guiding the plain paper PA is set within the range MA, and the second region 130B for guiding the first small-width sheet PB is set within the range MB. This makes it easy to prevent, on both the plain paper PA and the first small-width sheet PB having different bending rigidities, both transfer failure due to the discharge and transfer failure due to an increase in transport load.

MODIFICATION EXAMPLES

Next, the modification examples of the tip end portion of the guide member will be described.

First Modification Example

First, a first modification example will be described.

Figure 8:
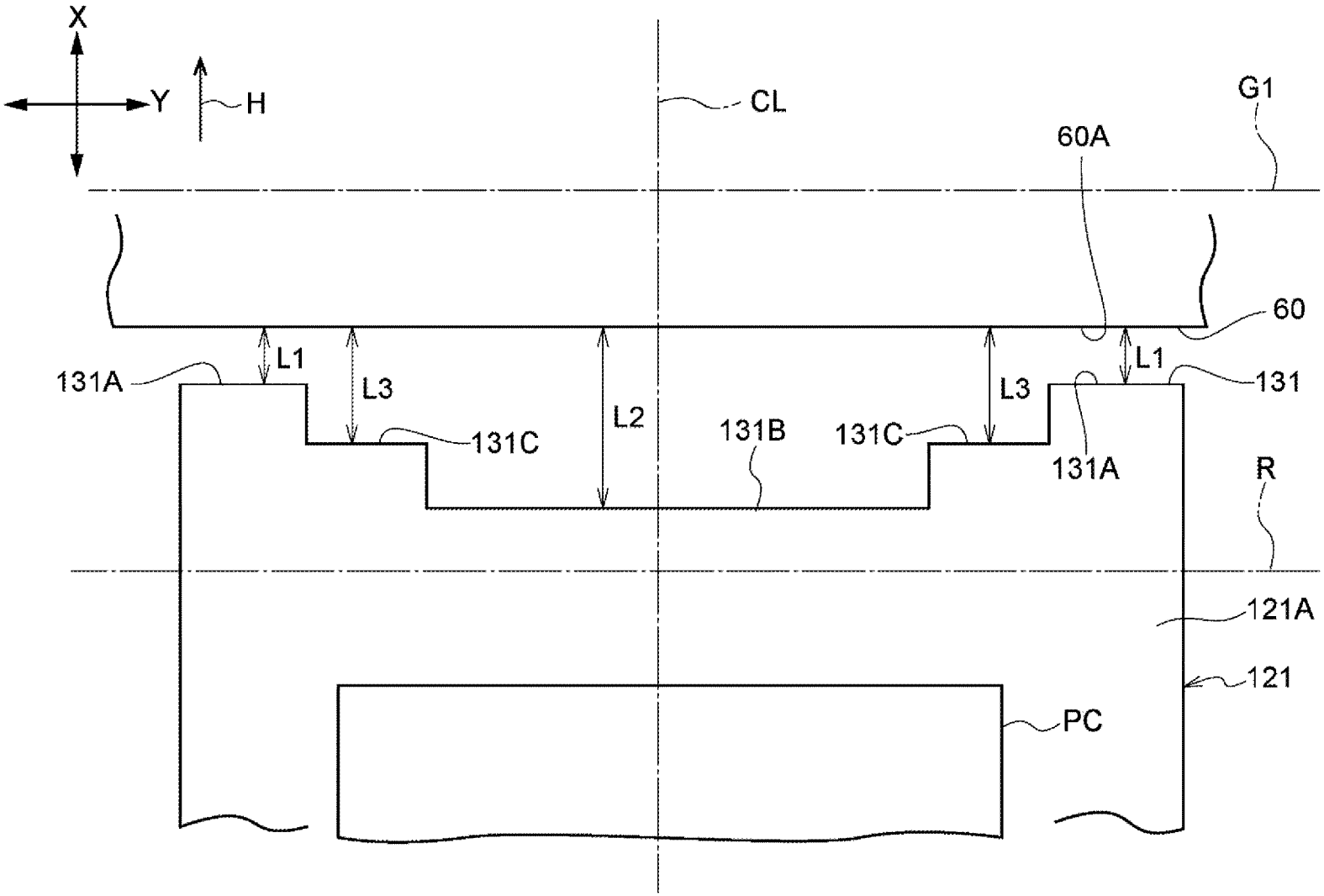
FIG. 8 is a plan view of a tip end portion of a guide member of a first modification example.
Figure 9:
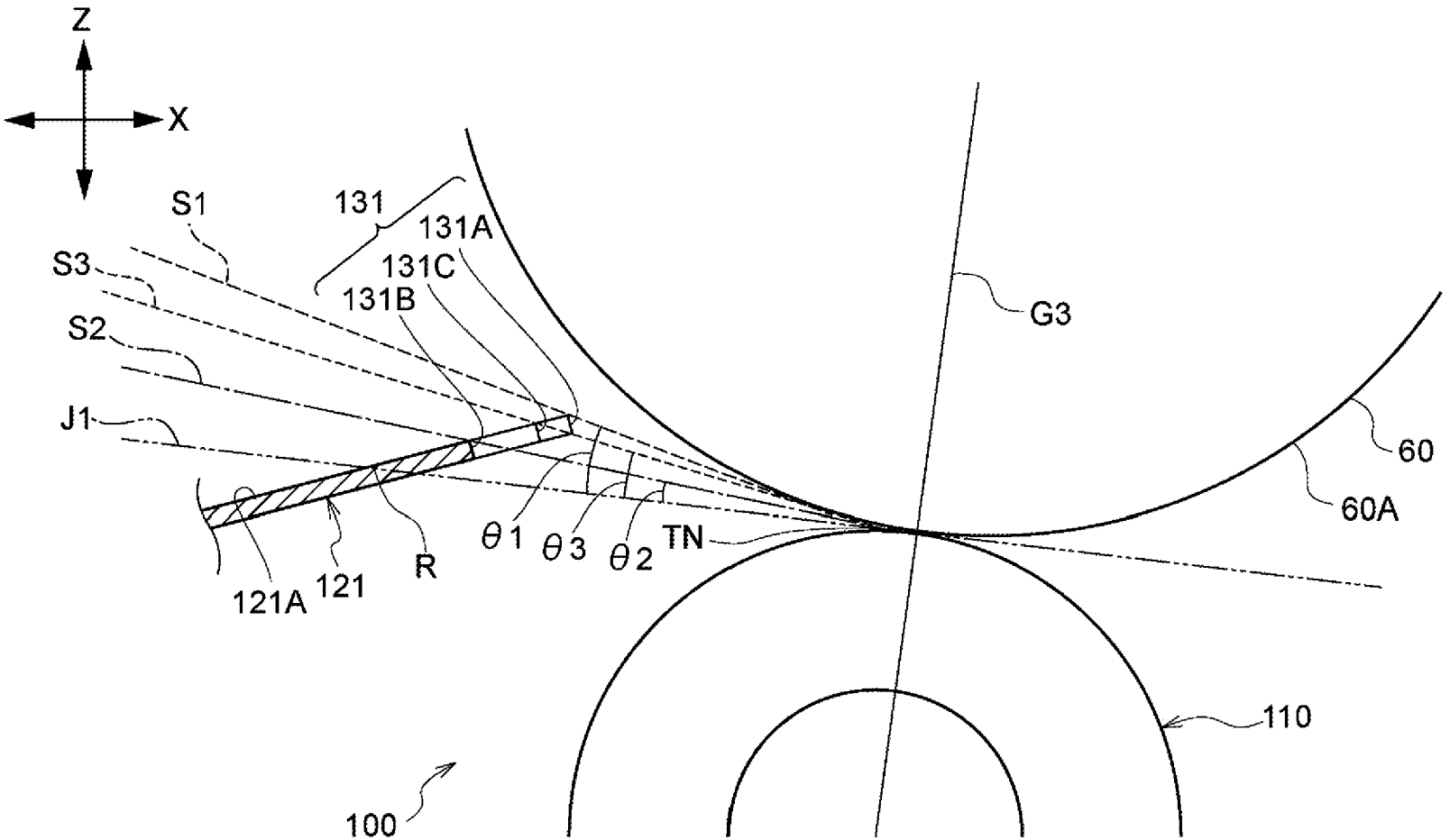
FIG. 9 is a side view of the tip end portion of the guide member of the first modification example viewed in the axial direction.

A guide member 121 of the first modification example is shown in FIGS. 8 and 9. In the present modification example, an image can be formed on at least three kinds of sheet materials P of a second small-width sheet PC (see FIG. 8) in addition to the plain paper PA (not shown) and the first small-width sheet PB (see FIG. 5).

The second small-width sheet PC (see FIG. 8) is a sheet material P such as a large-sized postcard which is thicker and has a smaller sheet width and a higher bending rigidity than the plain paper PA (not shown), but is thinner and has a larger sheet width and a smaller bending rigidity than the first small-width sheet PB (see FIG. 5). All the plain paper PA (not shown), the first small-width sheet PB (see FIG. 5), and the second small-width sheet PC (see FIG. 8) are transported such that the center in the sheet width direction passes through the center line CL.

As shown in FIG. 9, an upper guide surface 121A of the guide member 121 has an upward slope from the downstream side in the transport direction toward the downstream side in the transport direction. When viewed in the axial direction, the guide surface 121A of the guide member 121 intersects the tangent J1 of the transfer nip TN, and the tip end portion 131 on the downstream side in a transport direction is located closer to the photosensitive body 60 side than to the tangent J1. The intersection position R is a position at which the guide surface 121A of the guide member 121 intersects the tangent J1.

As shown in FIG. 8, the tip end portion 131 of the guide member 121 has first regions 131A, a second region 131B, and third regions 131C. Specifically, the tip end portion 131 of the guide member 121 has the first region 131A with the distance L1 on axial both sides, the second region 131B with the distance L2 at an axially central portion, and the third regions 131C with the distance L3 provided between the first regions 131A and the second region 131B. The term "distance" refers to the distance between the tip end portion 131 and the outer peripheral surface 60A of the photosensitive body 60 as described above. The distance L1 from the first region 131A and the distance L2 from the second region 131B are the same as in the first exemplary embodiment. The distance L3 is longer than the distance L1 from the first region 131A and shorter than the distance L2 from the second region 131B. That is, the relationship of distance L1<distance L3<distance L2 is established.

From another point of view, as shown in FIG. 9, the tip end portion 131 of the guide member 121 has, when viewed in the axial direction, a first region 131A with a virtual line S1 making an angle θ1 with the tangent J1, a second region 131B with a virtual line S2 making an angle θ2 with the tangent J1, and a third region 131C with a virtual line S3 making an angle θ3 with the tangent J1 provided between the first region 131A and the second region 131B. The virtual lines "S1, S2, and S3" are lines connecting the first, second, and third regions 131A, 131B, and 131C and the transfer nip TN. The angle θ1 and the angle θ2 are the same as those in the first exemplary embodiment. The angle θ1 is larger than the angle θ2, and the angle θ3 is smaller than the angle θ1 and larger than the angle θ2. That is, the relationship of angle θ1>angle θ3>angle θ2 is established.

The above-described plain paper PA (not show is guided to the transfer nip TN by the first region 131A of the tip end portion 131 of the guide member 121, the first small-width sheet PB (see FIG. 5) is guided to the transfer nip TN by the second region 131B of the tip end portion 131 of the guide member 121, and the second small-width sheet PC (see FIG. 8) is guided to the transfer nip TN by the third region 131C.

Operation

Next, the operation of the present modification example will be described.

The second small-width sheet PC which is thicker and has a smaller width and a higher bending rigidity than the plain paper PA but is thinner and has a larger width and a smaller bending rigidity than the first small-width sheet PB is guided to the transfer nip TN by the third region 131C, which is closer and makes a larger angle than the second region 131B, so that transfer failure due to discharge is effectively prevented while transfer failure due to an increase in transport load is prevented.

As described above, for any one of the plain paper PA, the first small-width sheet PB, and the second small-width sheet PC having different bending rigidities, transfer failure due to discharge and transfer failure due to an increase in transport load are effectively prevented.

Second Modification Example

Next, a second modification example will be described.

Figure 10:
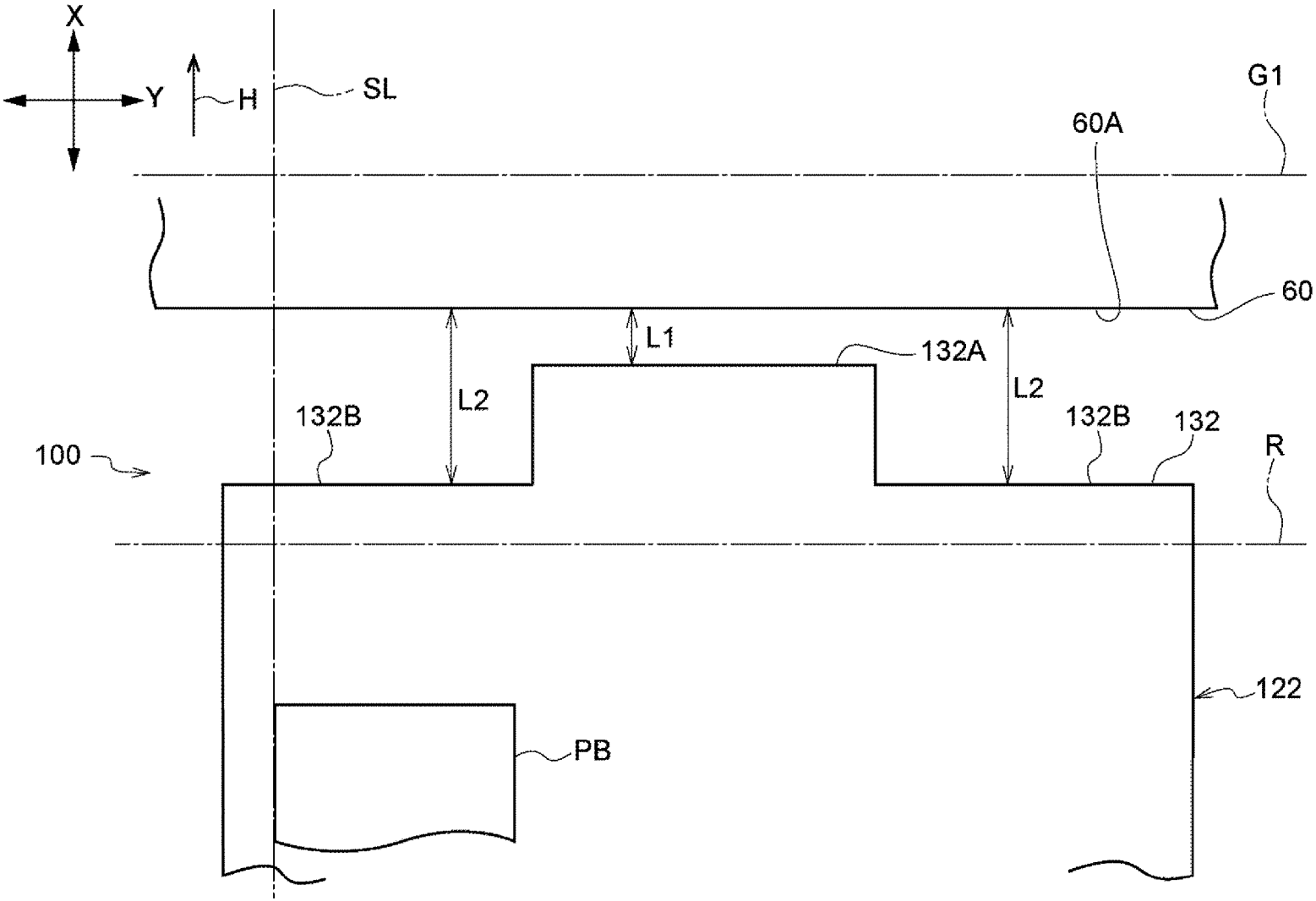
FIG. 10 is a plan view of a tip end portion of a guide member of a second modification example.

FIG. 10 shows a guide member 122 of the second modification example. In the present modification example, an end line SL which is the axial end of the transporting path is shown. In the present exemplary embodiment, the end line SL is used as a transport reference of the sheet material P, and the sheet material P is sported such that the end portion in the sheet width direction passes through the end line SL.

In the present modification, an image can be formed on at least two kinds of the sheet materials P of the plain paper PA (not shown) and the first small-width sheet PB (see FIG. 5). Both the plain paper PA and the first small-width sheet PB are transported such that the end portion in the sheet width direction passes through the end line SL.

A tip end portion 132 of the guide member 122 has a first region 132A and a second region 132B. Specifically, the tip end portion 132 of the guide member 122 has the first region 132A with the distance L1 at the axially central portion and the second region 132B with the distance L2 at axial both sides of the first region 132A. In other words, in a plan view, the tip end portion 132 of the guide member 122 has a convex shape. The distance L1 from the first region 132A and the distance L2 from the second region 132B are the same as in the first exemplary embodiment.

In the tip end portion 132 of the guide member 122, when viewed in the axial direction, the angle between the tangent J1 and a virtual line connecting the first region 132A and the transfer nip TN (see FIG. 6) is the same as the above-mentioned angle θ1 (see FIG. 6), and the angle between the tangent J1 and a virtual line connecting the second region 132B and the transfer nip TN (see FIG. 6) is the same as the above-mentioned angle θ2 (see FIG. 6).

The above-described plain paper PA (not shown) is guided to the transfer nip TN by the first region 132A of the tip end portion 132 of the guide member 120, and the above-described first small-width sheet PB (see FIG. 5) is guided to the transfer nip TN by the second region 131B of the tip end portion 132 of the guide member 122.

Operation

Next, the operation of the present modification example will be described.

The first small-width sheet PB is guided by the second region 130B with a longer distance to the photosensitive body 60 (FIG. 5) and a smaller angle between the tangent J1 and the virtual line S2 connecting the second region 130B and the transfer nip TN. Therefore, an increase in the transport load of the first small-width sheet PB is prevented, and the occurrence of transfer failure such as displacement of a toner image is prevented.

As described above, for both the plain paper PA and the first small-width sheet PB having different bending rigidity, transfer failure due to discharge and transfer failure due to an increase in transport load are prevented.

Third Modification Example

Next, a third modification example will be described.

Figure 11:
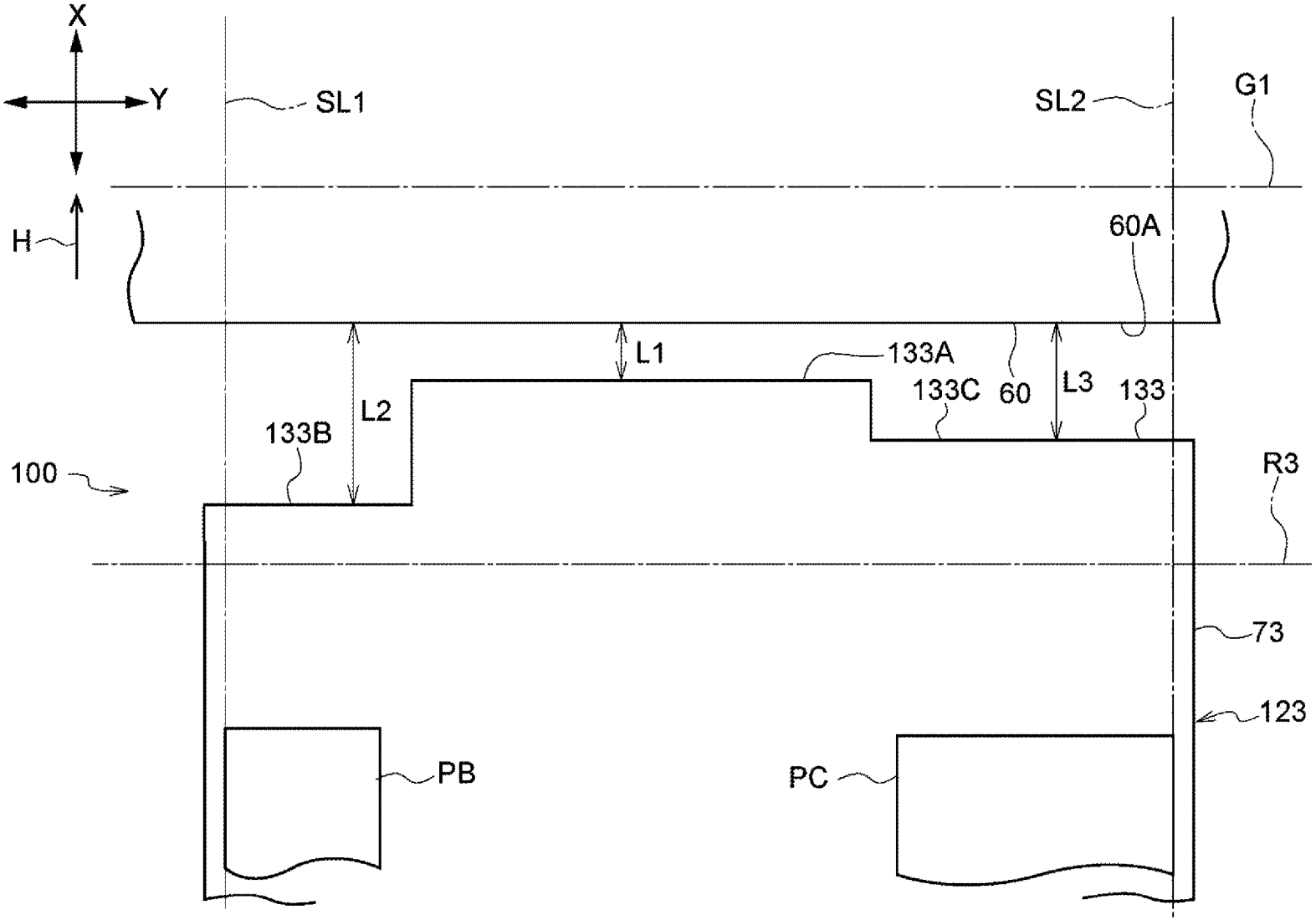
FIG. 11 is a plan view of a tip end portion of a guide member of a third modification example.

FIG. 11 shows a guide member 123 of the third modification example. In the present modification example, a first end line SL1 which is an end portion on one side in the axial direction in the transporting path and a second end line SL2 which is an end portion on the other side are shown. In the present exemplary embodiment, the first end line SL1 and the second end line SL2 are used as the transport reference of the sheet material P, and the sheet material P is transported such that an end portion in the sheet width direction passes through either the first end line SL1 or the second end line SL2.

In the present modification, an image can be formed on at least three kinds of sheet materials P of the plain paper PA (not shown), the first small-width sheet PB, and the second small-width sheet PC.

The plain paper PA and the first small-width sheet PB are transported such that one end portion in the sheet width direction passes through the first end line SL1. The second small-width sheet PC is transported such that the other end portion in the sheet width direction passes through the second end line SL2.

A tip end portion 133 of the guide member 123 has a first region 133A, a second region 133B, and a third region 133C. Specifically, the tip end portion 133 of the guide member 123 has the first region 132A at the axially central portion, the second region 133B at axial one side of the first region 132A, and the third region 133C at the axial other side of the first region 132A.

The distance L1 between the first region 133A and the outer peripheral surface 60A of the photosensitive body 60 is the same as the above-mentioned distance L1, the distance L2 between the second region 133B and the outer peripheral surface 60A of the photosensitive body 60 is the same as the above-mentioned distance L2, and the distance L3 between the third region 133C and the outer peripheral surface 60A of the photosensitive body 60 is the same as the above-mentioned distance L3.

Also with respect to the tip end portion 133 of the guide member 123 is, when viewed in the axial direction, the angle between the tangent J1 and a virtual line connecting the first region 133A and the transfer nip TN (see FIG. 9) is the same as the above-mentioned angle θ1 (see FIG. 9), and the angle between the tangent J1 and a virtual line connecting the second region 133B and the transfer nip TN (see FIG. 9) is the same as the above-mentioned angle θ2 (see FIG. 9). The angle between the tangent J1 and a virtual line connecting the third region 133C and the transfer nip TN (see FIG. 9) is the same as the angle θ3 (see FIG. 9) in the above-described first modification example.

Since the first small-width sheet PB is transported such that one end portion in the sheet width direction passes through the first end line SL1, it is transported to the transfer nip TN in the second region 133B. Since the second small-width sheet PC is transported such that the other end portion in the sheet width direction passes through the second end line SL2, it is guided to the transfer nip TN by the third region 133C. The above-described plain paper PA (not shown) is guided to the transfer nip TN in the first region 133A of the tip end portion 133 of the guide member 123.

Operation

Next, the operation of the present modification example will be described.

The second small-width sheet PC, which is thicker and has a smaller width and a larger bending rigidity than the plain paper PA, but is thinner and has a larger width and a smaller bending rigidity than the first small-width sheet PB, is guided to the transfer nip TN by the third region 133C, which is closer and makes a larger angle than the second region 133B, so that transfer failure due to discharge is effectively prevented while transfer failure due to an increase in transport load is prevented.

As described above, for any one of the plain paper PA, the first small-width sheet PB, and the second small-width sheet PC having different bending rigidities, transfer failure due to discharge and transfer failure due to an increase in transport load are effectively prevented.

Others

The present disclosure is not limited to the above-described exemplary embodiment.

For example, although the guide members 120, 121, 122, and 123 of the above-described exemplary embodiment and the modification examples are formed of a metal plate, it is not limited to this. The guide members 120, 121, 122, and 123 may be made of a conductive resin. The electric resistance of the guide members when made of a conductive resin is preferably $10^9$ to $10^{17}\Omega$.

For example, in the above-described exemplary embodiment and modification examples, the toner image is transferred from the photosensitive body 60 to the sheet material P as an example of a recording medium, but is not limited thereto. The toner image may be primarily transferred from the photosensitive body to the intermediate transfer body as an example of an image holding member, and secondarily transferred from the intermediate transfer body to the sheet material P.

The configuration of the image forming apparatus is not limited to the configuration of the above-described exemplary embodiment, and various configurations can be made. Various modifications may be made without departing from the scope of the present disclosure.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A transfer unit comprising:

a transfer body that forms a transfer nip together with an image holding member provided to hold a developer image, wherein the transfer body is configured to allow a recording medium to be nipped in and transported through the transfer nip so that a developer image is transferred onto the recording medium; and a guide member that intersects a tangent to the transfer nip and has a tip end portion located closer to the image holding member across the tangent when viewed in an axial direction, wherein the guide member is configured to guide the recording medium transported from an upstream side to the transfer nip, wherein the tip end portion has a plurality of regions, wherein the tip end portion is configured such that virtual lines passing through the plurality of regions and the transfer nip make different angles with the tangent, wherein the plurality of regions comprises:

first regions formed on both sides in the axial direction; and a second region formed between the first regions at an axially central portion of the tip end portion, and wherein the second region has a width in the axial direction that is wider than a width of a narrowest recording medium that the transfer unit is configured to use.

2. The transfer unit according to claim 1, wherein the tip end portion is configured such that a virtual line connecting the second region and the transfer nip makes a smaller angle with the tangent than a virtual line connecting the first region and the transfer nip.

3. The transfer unit according to claim 2, wherein the tip end portion has a third region formed between the first and second regions, and wherein the tip end portion is configured such that a virtual line connecting the third region and the transfer nip makes a smaller angle with the tangent than a virtual line connecting the first region and the transfer nip and makes a larger angle with the tangent than a virtual line connecting the second region and the transfer nip.

4. An image forming apparatus comprising:

an image forming unit configured to form the developer image on the image holding member;

the transfer unit according to claim 1, wherein the transfer unit is configured to transfer the developer image formed on the image holding member to the recording medium; and a fixing device configured to fix the developer image transferred to the recording medium.

5. The transfer unit according to claim 1, wherein the second region has a width in the axial direction that is wider than a width of any one of the first regions in the axial direction.

* * * * *